US007155146B2

(12) United States Patent
Kosuge et al.

(10) Patent No.: US 7,155,146 B2
(45) Date of Patent: Dec. 26, 2006

(54) METHOD AND APPARATUS FOR ELECTRO PHOTOGRAPHIC IMAGE FORMING CAPABLE OF EFFECTIVELY PERFORMING AN EVENLY CHARGING OPERATION

(75) Inventors: Akio Kosuge, Yokohama (JP); Hiroshi Ono, Tokyo (JP); Kaoru Yoshino, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 36 days.

(21) Appl. No.: 10/992,807

(22) Filed: Nov. 22, 2004

(65) Prior Publication Data

US 2005/0185989 A1 Aug. 25, 2005

(30) Foreign Application Priority Data

Nov. 20, 2003 (JP) ..... 2003-390063

(51) Int. Cl.
*G03G 15/02* (2006.01)

(52) U.S. Cl. ..... 399/168; 399/176

(58) Field of Classification Search ..... 399/168, 399/175, 176, 159, 313, 314
See application file for complete search history.

(56) References Cited

U.S. PATENT DOCUMENTS

| | | | | |
|---|---|---|---|---|
| 5,396,319 | A | 3/1995 | Tokuhashi et al. | |
| 5,867,759 | A | 2/1999 | Isobe et al. | |
| 5,983,060 | A | 11/1999 | Namekata et al. | |
| 6,122,468 | A | 9/2000 | Sakamoto et al. | |
| 6,249,304 | B1 | 6/2001 | Sawayama et al. | |
| 6,505,022 | B1 | 1/2003 | Kosuge et al. | |
| 6,546,219 | B1 * | 4/2003 | Sato et al. | 399/176 |
| 6,560,438 | B1 | 5/2003 | Kosuge | |
| 6,567,637 | B1 | 5/2003 | Yanagisawa et al. | |
| 6,576,388 | B1 | 6/2003 | Sakon et al. | |
| 6,697,595 | B1 | 2/2004 | Kawagoe et al. | |
| 6,748,190 | B1 | 6/2004 | Yanagisawa et al. | |
| 6,768,879 | B1 | 7/2004 | Kosuge | |
| 6,775,511 | B1 | 8/2004 | Kosuge | |
| 6,807,390 | B1 | 10/2004 | Suda et al. | |

(Continued)

FOREIGN PATENT DOCUMENTS

JP 07-209959 * 11/1995

(Continued)

OTHER PUBLICATIONS

Patent Abstracts of Japan, JP 07-168417, Jul. 4, 1995.

*Primary Examiner*—Hoang Ngo
(74) *Attorney, Agent, or Firm*—Oblon, Spivak, McClelland, Maier & Neustadt, P.C.

(57) ABSTRACT

An image forming apparatus includes an image bearing member having a photoconductive surface including an image forming area configured to bear an electrostatic latent image and a non-image forming area. A charging roller has a circular cross section with a first radius, the charging roller including a metallic core having a same rotational axis as the charging roller and a charging surface configured to charge the photoconductive surface of the image bearing member. A pair of gap forming members is disposed on longitudinal ends of the charging surface of the charging roller and is configured to contact longitudinal ends of the image bearing member to form a gap at least between the image forming area of the photoconductive surface of the image bearing member and the charging surface of the charging roller, each of the gap forming members having a circular cross section with a second radius such that a ratio of the second radius to the first radius is substantially constant through an entire rotational phase of the charging roller.

39 Claims, 5 Drawing Sheets

U.S. PATENT DOCUMENTS

| | | | | |
|---|---|---|---|---|
| 6,829,444 | B1 | 12/2004 | Ashikawa | |
| 6,951,688 | B1 * | 10/2005 | Kato et al. | 428/413 |
| 2003/0175046 | A1 | 9/2003 | Namiki et al. | |
| 2003/0185585 | A1 | 10/2003 | Kimura et al. | |
| 2004/0109706 | A1 | 6/2004 | Kosuge et al. | |

FOREIGN PATENT DOCUMENTS

| | | |
|---|---|---|
| JP | 8-004749 | 1/1996 |
| JP | 8-272190 | 10/1996 |
| JP | 8-339092 | 12/1996 |
| JP | 11-218999 | 8/1999 |
| JP | 2000-206762 | 7/2000 |
| JP | 2000-206805 | 7/2000 |
| JP | 2000-275877 | 10/2000 |
| JP | 2001-109235 | 4/2001 |
| JP | 2001-194868 | 7/2001 |
| JP | 2001-312121 | 11/2001 |
| JP | 2001-337515 | 12/2001 |
| JP | 2002-318483 | 10/2002 |
| JP | 2003-076113 | 3/2003 |
| JP | 2003-223055 | 8/2003 |
| JP | 2003-316119 | 11/2003 |

* cited by examiner

METHOD AND APPARATUS FOR ELECTRO PHOTOGRAPHIC IMAGE FORMING CAPABLE OF EFFECTIVELY PERFORMING AN EVENLY CHARGING OPERATION

CROSS REFERENCE TO RELATED APPLICATION

This application claims priority to Japanese patent application no. 2003-390063, filed on Nov. 20, 2003, the disclosure of which is incorporated by reference herein in its entirety.

BACKGROUND OF THE INVENTION

1. Field of the Invention

The present invention relates to a method and apparatus for image forming.

2. Discussion of the Background

Generally, an image forming apparatus includes a charging unit for charging an image bearing member (e.g., a photoconductive element) during an image forming process. While a non-contact type charging unit, such as a scorotron charger, corotron charger or similar charger that does not contact the image bearing member, has commonly been used, a contact-type charging unit is increasingly used because the non-contact type charging unit produces a large amount of undesirable discharge products including ozone. An example of a well known contact-type charging unit is a charging unit having a charging roller pressed against the image bearing member, the charging roller having a rubber or resin surface. However, toner and impurities accumulate on the surface of the charging member affecting the regularity of the charge, thereby reducing a usable life of the charging unit.

To solve the above-described problem, a charging unit is provided with films wrapped around and adhered to opposite end portions of a charging member over the entire circumference and has a contact with an image bearing member to form a predetermined gap between a center portion of the charging member and the image bearing member. In this configuration, the center portion of the charging member does not contact the image forming area of the image bearing member and is therefore free from accumulation of adherents. The films, however, peel at seams in the circumferential direction of the charging member due to repeated contact of the charging member and the image bearing member.

Another technique includes a charging member having a resin material instead of an elastic material such as a rubber and sponge. In other techniques, inorganic fine particles are dispersed on a surface of an organic image bearing member or siloxane cross-linking resin is used so that a protective layer is formed on a surface of the organic image bearing member to increase its abrasion resistance and mechanical strength.

However, a charging member that has a roller shape and made up of a rubber material has difficulty in cutting with high accuracy and causes high thermal expansion, thereby causing gap fluctuations resulting from environmental changes. Conversely, a charging member including a roller-shape resin material has a high degree of hardness so that cutting of the charging member during manufacture can be easily performed with high accuracy. When a gap forming member is formed by a film member wrapped around both ends of the charging member, however, the hardness of the charging member may cause problems that the film is abraded with age, and that toner adheres to an adhesive agent at an end of the film. When an image bearing member includes an organic material, the image bearing member may be damaged at a position where the image bearing member is held in contact with the film member.

To solve the above-described problems, a charging member includes rollers mounted on both ends of the charging member to form a gap between the charging member and an image bearing member. That is, gap forming members are held in contact with a non-image forming area of the image bearing member so that a photoconductive layer may not be deteriorated.

Referring to FIG. 1, a structure of a background charging unit contacting an image bearing member 215 is described.

In FIG. 1, the image bearing member 215 includes a tube 205 and a photoconductive layer 204 coated around an image forming area on a surface of the tube 205. That is, a non-image forming area of the tube 205 is left uncoated.

The background charging unit includes a charging member 214 and a pair of gap forming members 203. The charging member 214 includes a metallic core 201 and a resin layer 202 formed around the metallic core 201. The gap forming members 203 are arranged at both ends of the charging member 214. The gap forming members 203 are held in contact with respective ends of the tube 205 of the image bearing member 215, at non-coated area of the both ends of the image bearing member 205.

By this arrangement, however, leakage of a charge bias can occur in the non-image forming area of the image bearing member 215 from the ends of the charging member 214, and thus a sufficient distance (gap) should be maintained between the charging member 214 and the pair of gap forming members 203, as shown in FIG. 1. In this case, the tube 205 of the image bearing member 215 is extended in a longitudinal direction, thereby causing the image forming apparatus to become large in size.

SUMMARY OF THE INVENTION

An object of the present invention is to provide an electro photographic image forming apparatus capable of effectively performing an even charging operation.

Another object of the present invention is to provide a charging unit included in the above-described image forming apparatus and integrally mounted by the charging member and the pair of gap forming members.

Another object of the present invention is to provide a process cartridge including an image bearing member and the above-described charging unit.

These and/or other objects can be provided by an image forming apparatus including an image bearing member having a photoconductive surface including an image forming area configured to bear an electrostatic latent image and a non-image forming area, a charging roller having a circular cross section with a first radius, the charging roller including a metallic core having a same rotational axis as the charging roller and a charging surface configured to charge the photoconductive surface of the image bearing member, and a pair of gap forming members disposed on longitudinal ends of the charging surface of the charging roller and configured to contact longitudinal ends of the image bearing member to form a gap at least between the image forming area of the photoconductive surface of the image bearing member and the charging surface of the charging roller, each of the gap forming members having a circular cross section with a second radius such that a ratio of the second radius to the first radius is substantially constant through an entire rotational phase of the charging roller.

The present invention further provides an image forming apparatus including means for bearing an image, the means for bearing having a photoconductive surface including an image forming area and a non-image forming area, means for charging the means for bearing, the means for charging having a circular cross section with a first radius, the means for charging including a metallic core having a same rotational axis as the means for charging and a charging surface configured to charge the photoconductive surface of the means for bearing, and means for forming a gap disposed on longitudinal ends of the charging surface of the means for charging and configured to contact longitudinal ends of the means for bearing, the means for forming a gap configured to form a gap at least between the image forming area of the photoconductive surface of the means for bearing and the charging surface of the means for charging, the means for forming having a circular cross section with a second radius such that a ratio of the second radius to the first radius is substantially constant through an entire rotational phase of the means for charging.

The present invention still further provides a method of forming an image including providing an image bearing member having a photoconductive surface including an image forming area configured to bear an electrostatic latent image and a non-image forming area, providing a charging roller having a circular cross section with a first radius, the charging roller including a metallic core having a same rotational axis as the charging roller and a charging surface, providing a pair of gap forming members, each of the gap forming members having a circular cross section with a second radius, mounting the pair of gap forming members on the charging roller such that a ratio of the second radius to the first radius is substantially constant through a whole rotational phase of the charging roller, arranging the charging roller integrally mounted by the pair of gap forming members such that the charging roller is disposed parallel to and close to the image bearing member and the pair of gap forming members is held in contact with longitudinal ends of the image bearing member to form a gap at least between the image forming area of the photoconductive surface of the image bearing member and the charging surface of the charging roller, uniformly charging the image forming area on the surface of the image bearing member, and forming an electrostatic latent image in the image forming area on the surface of the image bearing member.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
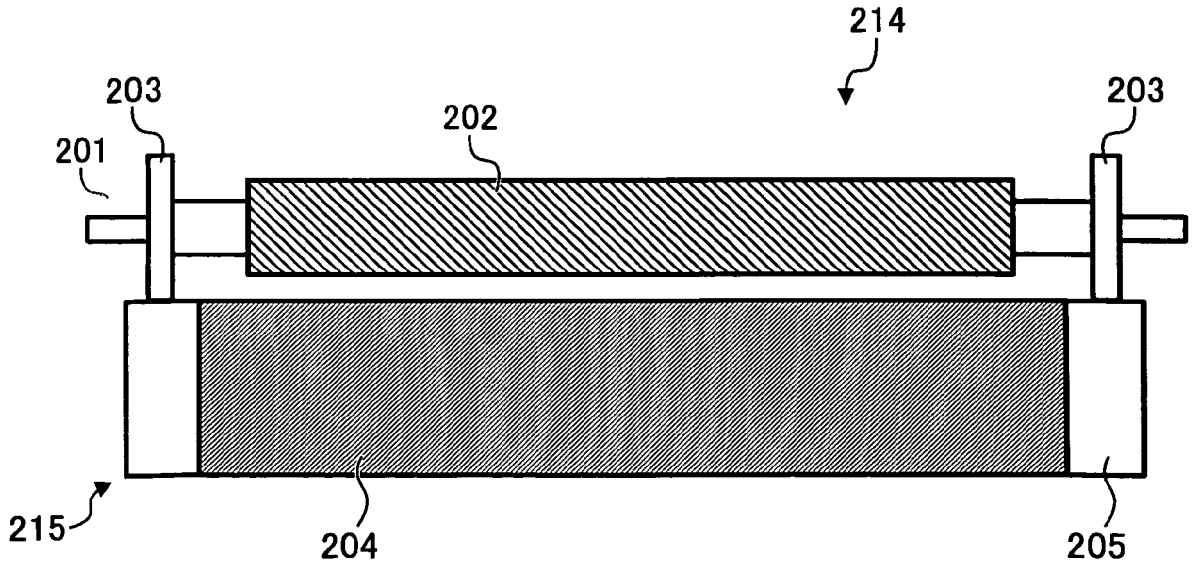
FIG. 1 PRIOR ART
FIG. 1 is a front view of a background charging roller contacting an image bearing member.

In describing preferred embodiments illustrated in the drawings, specific terminology is employed for the purpose of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

Figure 2:
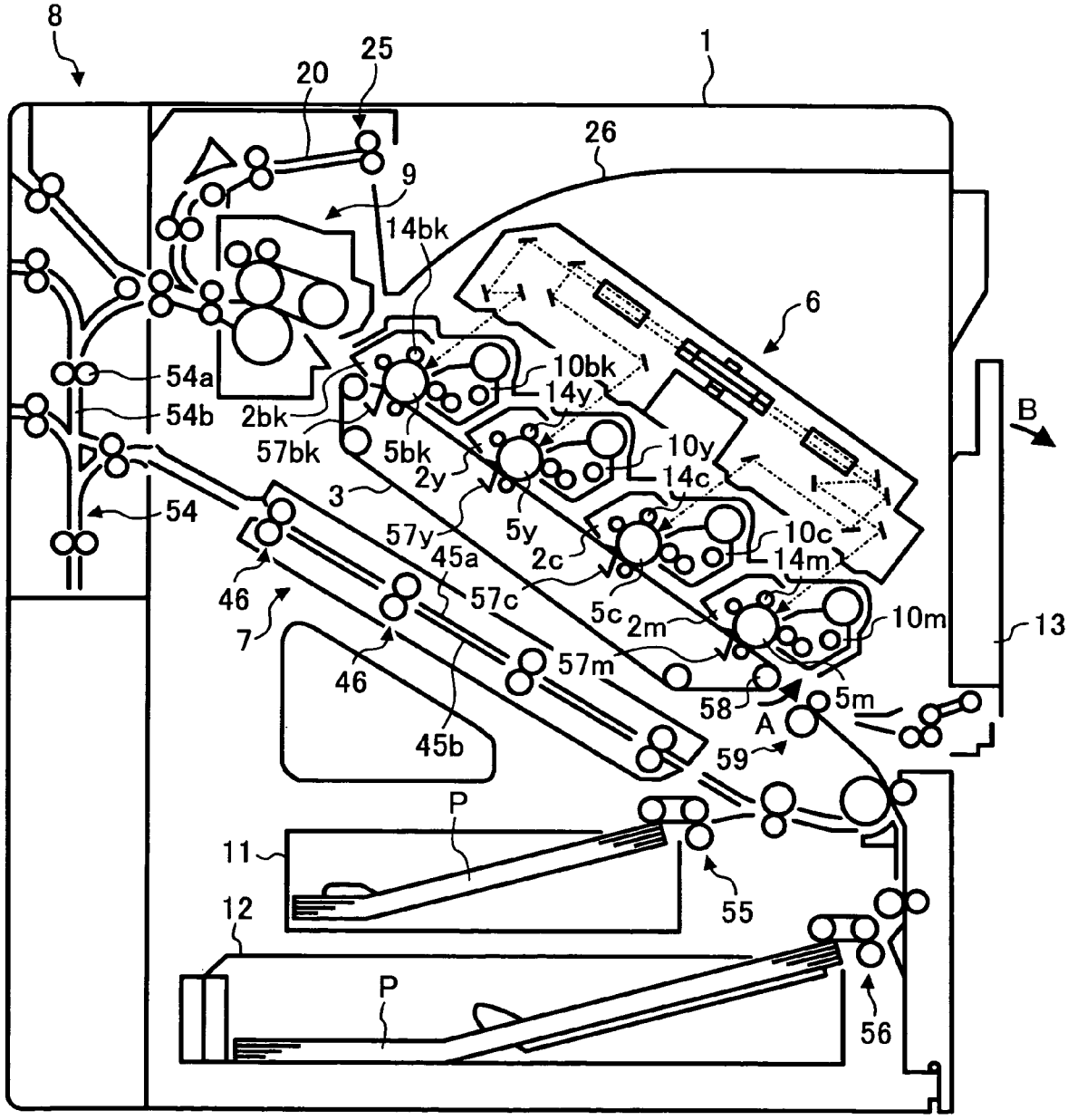
FIG. 2 is a schematic view of an image forming apparatus according to an embodiment of the present invention.

Referring to FIG. 2, a printer 1 is shown as one example of an electro photographic image forming apparatus according to an embodiment of the present invention. Although the printer 1 of FIG. 2 is configured to form a color image with toners of four different colors, such as magenta (m), cyan (c), yellow (y) and black (bk), the image forming apparatus can be a monochromatic printer, a copier, a facsimile machine and other image forming apparatus.

The printer 1 can include four photoconductive units 2*m*, 2*c*, 2*y* and 2*bk* as an image forming mechanism, an image transfer belt 3 as a transfer mechanism, a writing unit 6 as a writing mechanism, a fixing unit 9 as a fixing mechanism, a toner replenishing unit (not shown) as a toner feeding mechanism, and sheet feeding cassettes 11 and 12 as a sheet feeding mechanism.

The four photoconductive units 2*m*, 2*c*, 2*y* and 2*bk* include four photoconductive elements 5*m*, 5*c*, 5*y* and 5*bk*, respectively, and four charging rollers 14*m*, 14*c*, 14*y* and 14*bk*, respectively. The four photoconductive units 2*m*, 2*c*, 2*y* and 2*bk* can have similar structures and functions, except that the toners are different colors to form magenta images, cyan images, yellow images and black images, respectively.

The four photoconductive units 2*m*, 2*c*, 2*y* and 2*bk* are separately arranged at positions having different heights or elevations, in a stepped manner.

The photoconductive elements 5*m*, 5*c*, 5*y* and 5*bk* separately receive respective light laser beams emitted by the writing unit 6, such that electrostatic latent images are formed on the surfaces of the four photoconductive units 2*m*, 2*c*, 2*y* and 2*bk*.

The charging rollers 14*m*, 14*c*, 14*y* and 14*bk* are held in contact with the photoconductive elements 5*m*, 5*c*, 5*y* and 5*bk* to charge respective surfaces of the photoconductive elements 5*m*, 5*c*, 5*y* and 5*bk*.

Developing units 10*m*, 10*c*, 10*y* and 10*bk* are separately disposed in a vicinity of or adjacent the photoconductive units 2*m*, 2*c*, 2*y* and 2*bk*, respectively. The developing units 10*m*, 10*c*, 10*y* and 10*bk* store the different colored toners for the respective photoconductive units 2*m*, 2*c*, 2*y* and 2*bk*.

In this embodiment, the developing units 10*m*, 10*c*, 10*y* and 10*bk* can have structures and functions similar to one another, and respectively contain a two-component type developer including a toner and a carrier mixture. More specifically, the developing units 10*m*, 10*c*, 10*y* and 10*bk* respectively use magenta toner, cyan toner, yellow toner, and black toner.

Each of the developing units 10*m*, 10*c*, 10*y* and 10*bk* includes a developing roller (not shown) facing the respective photoconductive elements 5*m*, 5*c*, 5*y* and 5*bk*, a screw conveyor (not shown) for conveying the developer while agitating the developer, and a toner content sensor (not shown).

The developing roller includes a rotatable sleeve and a stationary magnet roller disposed in the rotatable sleeve.

The transfer mechanism including the image transfer belt 3 is located or disposed below the photoconductive units 2*m*, 2*c*, 2*y* and 2*bk* (substantially at the center of the printer 1). The image transfer belt 3 is passed over or surrounds a plurality of rollers including a paper attracting roller 58. The image transfer belt 3 is held in contact with the photoconductive elements 5*m*, 5*c*, 5*y* and 5*bk* and travels in a same direction as that in which the photoconductive elements 5*m*, 5*c*, 5*y* and 5*bk* rotate, as indicated by arrow A in FIG. 2.

Four image transfer brushes 57*m*, 57*c*, 57*y* and 57*bk* are disposed inside a loop of the image transfer belt 3 to face the respective photoconductive elements 5*m*, 5*c*, 5*y* and 5*bk*, which are accommodated in the photoconductive units 2*m*, 2*c*, 2*y* and 2*bk*.

The toner replenishing unit replenishes fresh toner to each of the developing units 10*m*, 10*c*, 10*y* and 10*bk* in accordance with an output of the toner content sensor.

The toner contains a binder resin, a colorant and a charge control agent and may include additives as well. The binder resin may be implemented by, e.g., polystyrene, styrene-acrylic ester copolymer or polyester resin. The colorant may be implemented by any one of conventional colorants. The content of the colorant should preferably be 0.1 parts by weight to 15 parts by weight for 100 parts by weight of binder resin.

As for the charge control agent, NIGROSINE, a chromium-containing complex, a quarternary ammonium salt or the like may be selectively used accordance with the polarity of toner particles. The content of the charge control agent is 0.1 parts by weight to 10 parts by weight for 100 parts by weight of binder resin.

A fluidity imparting agent may advantageously be added to toner particles. The fluidity imparting agent may be any one of fine particles of silica, titania, alumina or similar metal oxide, such fine particles whose surfaces are treated by a silane coupling agent, a titanate coupling agent or the like, and fine particles polystyrene, polymethyl methacrylate, polyvinylidene fluoride or similar polymer. The fluidity imparting agent should preferably have a particle size of approximately 0.01 μm to approximately 3 μm. The content of the fluidity imparting agent should preferably be 0.1 parts by weight to 0.7 parts by weight for 100 parts by weight of toner particles.

The toner for a two-component type developer according to the present invention may be produced by any one, or a combination, of conventional methods. For example, in a kneading and pulverizing method, the binder resin, carbon black or similar colorant and necessary additives are dry-mixed, heated, melted and kneaded by an extruder, double-roll or a triple-role, and cooled, solidified, pulverized by a jet mill or similar pulverizer, and then classified by a pneumatic classifier.

Alternately, the toner may be directly produced from a monomer, a colorant and additives by suspended polymerization or non-aqueous dispersion polymerization. Carrier particles generally include a core material or the core material provided with a coating layer. Magnetic material such as ferrite and magnetite may be used as the core material of the resin-coated carrier particles. A particle size of the core material may preferably be approximately 20 μm to approximately 60 μm. The material for forming a carrier coating layer may be any one of vinylidene fluoride, tetrafluoroethylene, hexafluoropropylene, perfluoroalkyl vinylether, vinyl ether with fluorine atoms substituted, and vinyl ketone with fluorine atoms substituted. The carrier coating layer may be formed by spraying the resin on the surfaces of the particles of the core material or by dipping the particles in the resin as used in a conventional method.

The writing unit 6 is provided at a position above the photoconductive units 2*m*, 2*c*, 2*y* and 2*bk*. The writing unit 6 has four laser diodes (LDs), a polygon scanner, and lenses and mirrors. The four laser diodes (LDs) serve as light sources and irradiate the respective photoconductive elements 5*m*, 5*c*, 5*y* and 5*bk* with respective imagewise laser light beams to form electrostatic latent images thereon. The polygon scanner including a polygon mirror having six surfaces and a polygon motor. Lenses such as f-theta lenses, elongate WTLs, and other lenses, and mirrors are provided in an optical path of the respective laser light beams. The laser light beams emitted from the laser diodes are deflected by the polygon scanner to irradiate the photoconductive elements 5*m* 5*c*, 5*y* and 5*bk*.

The sheet feeding mechanism is arranged in a lower portion of the printer 1, and includes the sheet feeding cassettes 11 and 12, sheet separation and feed units 55 and 56 assigned to the sheet feeding cassettes 11 and 12, respectively, and a pair of registration rollers 59. The sheet feeding cassettes 11 and 12 are loaded with a stack of sheets of particular size including a recording paper P. When an image forming operation is performed, the recording paper P is fed from one of the sheet feeding cassettes 11 and 12 and is conveyed toward the pair of registration rollers 59.

The sheet feeding mechanism also includes a duplex print unit 7, a reverse unit 8, a manual sheet feeding tray 13, a reverse discharging path 20, a sheet discharging roller pair 25 and a discharging tray 26.

The duplex print unit 7 is provided at a position below the image transfer belt 3. In addition, the reverse unit 8 is provided on a left side of the printer 1 of FIG. 2, which discharges a recording paper P on which an image is formed after reversing the recording paper P or feeds the recording paper P to the duplex print unit 7.

The duplex print unit 7 includes a pair of guide plates 45*a* and 45*b*, and four pairs of sheet feeding rollers 46. When a duplex image forming operation is performed, the duplex print unit 7 receives the recording paper P on one side of which an image is formed and which is fed to the duplex print unit 7 after the recording paper P is switched back at a reverse transporting passage 54 of the reverse unit 8. The duplex print unit 7 then transports the recording paper P to the sheet feeding mechanism.

The reverse unit 8 includes plural pairs of feeding rollers 54*a* and plural pairs of feeding guides 54*b* of the reverse transporting passage 54. As described above, the reverse unit 8 feeds the recording paper P on which an image is formed to the duplex print unit 7 after reversing the recording paper P or discharges the recording paper P without reversing the recording paper P.

The manual sheet feeding tray 13 is mounted on the right side of the printer 1 of FIG. 2. The manual sheet feeding tray 13 is openable in a direction indicated by arrow B. After opening the manual sheet feeding tray 13, an operator of the printer 1 may feed sheets by hand.

The fixing unit 9 serving as the fixing mechanism is positioned between the image transfer belt 3 and the reverse unit 8 for fixing an image formed on the recording paper P. The reverse discharge path 20 branches off a downstream side of the fixing unit 9 in the direction in which the recording paper P is conveyed, so that the recording paper P conveyed into the reverse discharge path 20 is driven out to the discharging tray 26 by a sheet discharging roller pair 25.

A full-color image forming operation of the printer 1 is now described.

When the printer 1 receives full color image data, each of the photoconductive elements 5*m*, 5*c*, 5*y* and 5*bk* rotates in a clockwise direction in FIG. 2 and is uniformly charged with the corresponding charging rollers 14*m*, 14*c*, 14*y* and 14*bk*. The writing unit 6 irradiates the photoconductive elements 5*m*, 5*c*, 5*y* and 5*bk* of the photoconductive units 2*m*, 2*c*, 2*y* and 2*bk* with the laser light beams corresponding to the respective color image data, resulting in formation of electrostatic latent images, which correspond to the respective color image data, on respective surfaces of the photoconductive elements 5*m*, 5*c*, 5*y* and 5*bk*. The electrostatic latent images formed on the respective photoconductive elements 5*m*, 5*c*, 5*y* and 5*bk* are developed with the respective developers including respective color toners at the respective developing units 10*m*, 10*c*, 10*y* and 10*bk*, resulting in formation of magenta, cyan, yellow and black toner images on the respective photoconductive elements 5*m*, 5*c*, 5*y* and 5*bk*.

The recording paper P is fed from one of the sheet feeding cassettes 11 and 12 with the respective sheet separation and feed units 55 and 56. The recording paper P is fed to the photoconductive units 2*m*, 2*c*, 2*y* and 2*bk* in synchronization with the pair of registration rollers 59 so that the color toner images formed on the photoconductive elements 5*m*, 5*c*, 5*y* and 5*bk* are transferred onto a proper position of the recording paper P.

The recording paper P is positively charged with the paper attracting roller 58, and thereby the recording paper P is electrostatically attracted by the surface of the image transfer belt 3. The recording paper P is fed while the recording paper P is attracted by the transfer belt 3, and the magenta, cyan, yellow and black toner images are sequentially transferred onto the recording paper P, resulting in formation of a full color image in which the magenta, cyan, yellow and black toner images are overlaid.

The full color toner image on the recording paper P is fixed by the fixing unit 9 through the application of heat and pressure. The recording paper P having the fixed full color image is fed through a predetermined passage depending on image forming instructions. Specifically, the recording paper P is discharged to the sheet discharging tray 26 with an image side facing downward, or is discharged from the fixing unit 9 after passing through the reverse unit 8. Alternatively, when a duplex image forming operation is specified, the recording paper P is fed to the reverse transporting passage 54 and is switched back to be fed to the duplex print unit 7. Then another image is formed on the other side of the recording paper P by the photoconductive units 2*m*, 2*c*, 2*y* and 2*bk*, and a duplex print copy having color images on both sides of the recording paper P is discharged. When a request producing two or more copies is specified, the image forming operation described above is repeated.

Next, the image forming operation for producing black and white copies is described.

When the printer 1 receives a command to produce black and white copies according to black and white image data, a driven roller (not shown) facing the paper attracting roller 58 and supporting the image transfer belt 3 is moved downward, thereby separating the image transfer belt 3 from the photoconductive units 2*m*, 2*c* and 2*y*. The photoconductive element 5*bk* of the photoconductive unit 2*bk* rotates in the clockwise direction in FIG. 2 to be uniformly charged with the corresponding charging roller 14*bk*. Then an image-wise laser light beam corresponding to the black and white image data irradiates the photoconductive element 5*bk*, resulting in formation of an electrostatic latent image on the photoconductive element 5*bk*. The electrostatic latent image formed on a surface of the photoconductive element 5*bk* is developed with the black developing device 10*bk*, resulting in formation of a black toner image on the photoconductive element 5*bk*. In this case, the photoconductive units 2*m*, 2*c* and 2*y*, and the developing units 10*m*, 10*c* and 10*y* are not activated. Therefore, undesired abrasion of the photoconductive elements 5*m*, 5*c* and 5*y* and undesired consumption of the toners other than the black toner can be prevented.

The recording paper P is fed from one of the paper feeding cassettes 11 and 12 with the respective one of the sheet separation and feed units 55 and 56. The recording paper P is fed to the photoconductive unit 2*bk* in synchronization with the pair of registration rollers 59 such that the black toner image formed on the photoconductive element 5*bk* is transferred to a proper position of the recording paper P.

The recording paper P is positively charged with the paper attracting roller 58 so that the recording paper P is electrostatically attracted by the surface of the image transfer belt 3. Since the recording paper P is fed while the recording paper P is attracted by the image transfer belt 3, the recording paper P can be fed to the photoconductive element 5*bk* even when the photoconductive elements 5*m*, 5*c* and 5*y* are separated from the image transfer belt 3, resulting in formation of the black color image on the recording paper P.

After the black toner image is fixed by the fixing unit 9, the recording paper P having the black toner image on the surface is discharged. When a request producing two or more copies is specified, the image forming operation described above is repeated.

To stably feed the recording paper P under electrostatic adhesion, at least the outermost layer of the image transfer belt 3 is made of a material having a high resistance. The image transfer belt 3 may be implemented as a seamless belt produced by molding polyvinylidene fluoride, polyimide, polycarbonate, polyethylene terephthalate or other similar resin. If desired, carbon black or similar conductive material may be added to such resin in order to control resistance. Further, the image transfer belt 3 may be provided with a laminate structure made up of a base layer formed of the above-described resin and a surface layer formed on the base layer by, for example, spray coating or dip coating.

Figure 3:
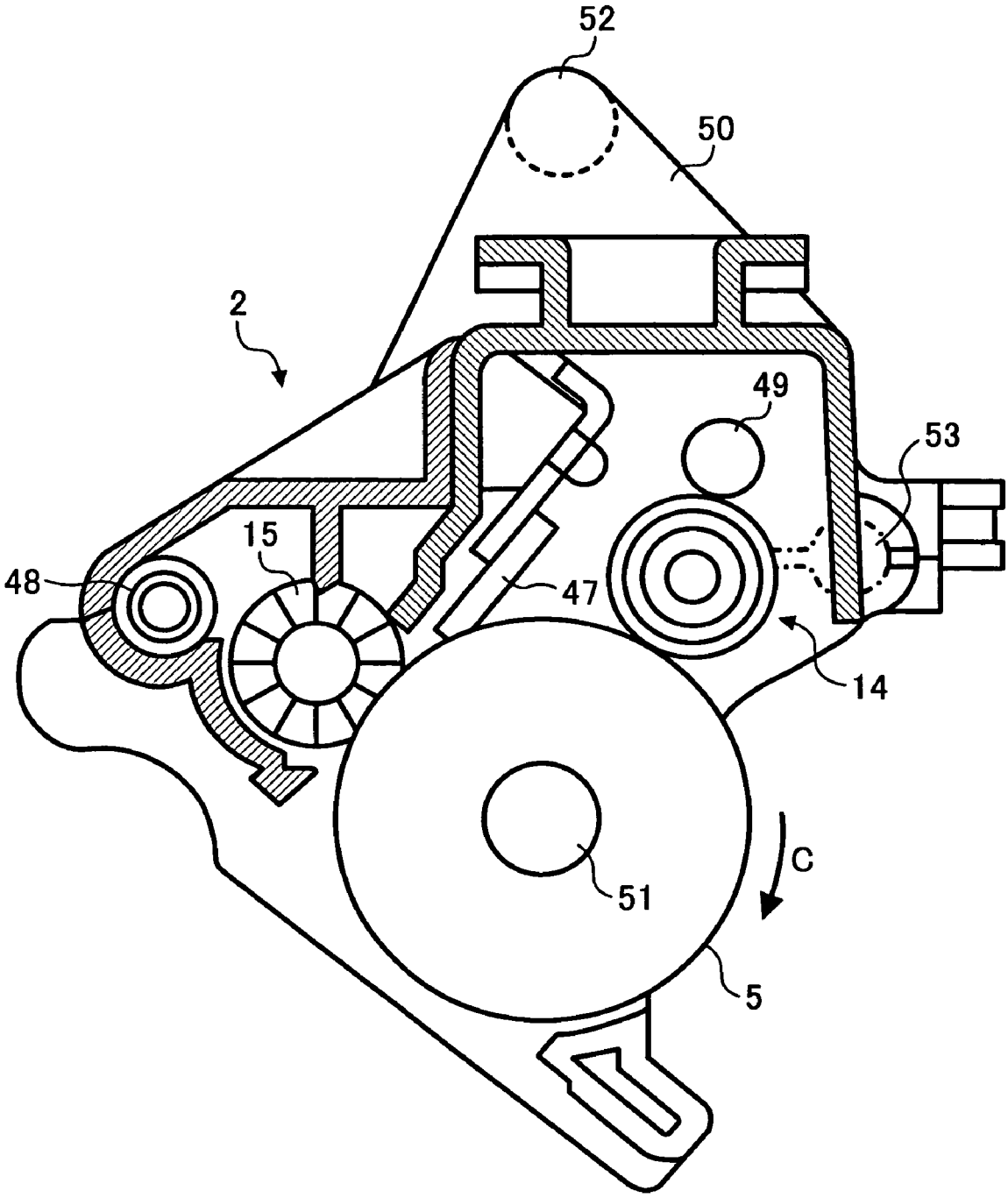
FIG. 3 is a detail view of a photoconductive unit included in the image forming apparatus of FIG. 2.

Referring to FIG. 3, a structure of one of the photoconductive units 2*m*, 2*c*, 2*y* and 2*bk* is described. Each of the photoconductive units 2*m*, 2*c*, 2*y* and 2*bk* has respective components around it. Since the photoconductive units 2*m*, 2*c*, 2*y* and 2*bk* have similar structures and functions to each other, except that the toners contained therein are of different colors, the discussion below with respect to FIGS. 3 to 7 use reference numerals for specifying components of the full-color printer 1 without suffixes indicative of colors such as m, c, y and bk. In other words, the photoconductive unit 2 of FIG. 3, for example, can be any one of the photoconductive drums 2*m*, 2*c*, 2*y* and 2*bk*.

As shown in FIG. 3, the photoconductive unit 2 includes the photoconductive element 5, the charging roller 14, a brush roller 15, a cleaning blade 47, a toner transporting auger 48 and a charge cleaning roller 49.

The brush roller 15 moves toner scraped off the photoconductive element 5 by the cleaning blade 47 toward the toner transporting auger 48. The toner transporting auger 48 removes toner particles adhered to the brush roller 15. In the illustrative embodiment, the photoconductive element 5 has a diameter of 30 mm, for example, and is caused to rotate at a speed of 125 mm/sec in a direction indicated by arrow C in FIG. 3. The brush roller 15 rotates in a clockwise direction in FIG. 3, in synchronization with the rotation of the photoconductive element 5.

The charge cleaning roller 49 cleans a surface of the charging roller 14.

The photoconductive unit 2 includes a main reference portion 51, a front subreference portion 52 and a rear subreference portion 53 for positioning. The subreference portions 52 and 53 are formed integrally with a single bracket 50. With this configuration, the photoconductive unit 2 can be accurately positioned relative to the printer 1 when the photoconductive unit 2 is mounted to the printer 1.

The photoconductive element 5 and the charging roller 14 are mounted on the photoconductive unit 2, and therefore are positioned relative to each other within the photoconductive unit 2. When the entire photoconductive unit 2 is replaced, the photoconductive element 5 and the charging roller 14 may be removed from the printer 1 integrally with each other. This allows even a user of the printer 1 to easily replace the photoconductive unit 2 without performing any gap adjustment. While the photoconductive element 5, the charging roller 14 and the cleaning blade 47 are shown as being formed into one unit, the cleaning blade 47 may be mounted to another unit. Further, the developing unit 10 may be formed into one unit together with the photoconductive element 5, the charging roller 14 and other image forming components in the photoconductive unit 2.

As described above, the charging roller 14 and the photoconductive element 5 may integrally be formed into a single process cartridge removably mounted to the printer 1. According to the above-described structure, the charging roller 14 and the photoconductive element 5 whose useful lives are extending do not need frequent replacement and can be easily replaced together.

The photoconductive element 5 includes a conductive core, an under layer formed on the conductive core, and a charge generating layer and a charge transport layer sequentially formed on the under layer. The charge generating layer and charge transport layer are formed of a charge generating substance and a charge transport substance, respectively.

The conductive core may be implemented as, for example, a pipe or cylinder formed of aluminum, stainless steel or similar metal or an endless belt formed of nickel, so long as the conductive core has volumetric resistance of $10^4$ Ωcm or less.

While the undercoat layer includes resins, the resins should preferably have high solution resistance against general organic solvents when consideration is given to the fact that a photoconductive layer is formed on the undercoat layer by use of a solvent. Resins of this kind include water soluble resin such as polyvinyl alcohol resin, alcohol soluble resin such as copolymerized nylon, and curing type resin forming a three-dimensional network, such as polyurethane resin, alkyd-melamine resin or epoxy resin. Fine powder of metal oxides, such as titanium oxide, silica and alumina may be added to the undercoat layer for obviating moir and reducing residual potential. The undercoat layer may be formed by use of a desired solvent and a desired coating method. A thickness of the undercoat layer may preferably be approximately 0 μm to approximately 5 μm.

The charge generating layer contains a charge generating material. Typical materials of the charge generating material are monoazo pigment, disazo pigment, trisazo pigment, and phthalocyanine-based pigment. The charge generating layer may be formed by dispersing the charge generating material together with the binder resin such as polycarbonate into a solvent, such as tetrahydrofuran or cyclohexanone to thereby prepare a dispersion solution, and coating the solution by dipping or spraying. A thickness of the charge generating layer is usually approximately 0.01 μm to approximately 5 μm.

The charge transport layer may be formed by dissolving or dispersing the charge transport material and binder resin into a desired solvent, e.g., tetrahydrofuran, toluene or dicycloethane, and coating and then drying the resulting mixture. Among the charge transport materials, the charge transport materials of low molecular weight include an electron transport material and a hole transport material. The electron transport material may be implemented by an electron receiving material, e.g., chloranil, bromanil, tetracyanoethylene, tetracyanoquinodimethane, 2,4,7-trinitro-9-fluorenone, 2,4,5,7-tetranitro-9-fluorenone, or 1,3,7-trinitrodibenzothiophene-5,5-dioxide. The hole transport material may be implemented by an electron donative material, e.g., oxazole derivatives, oxadiazole derivatives, imidazloe derivatives, triphenylamine derivatives, phenyl hydrazones, α-phenylstilbene derivatives, thiazole derivatives, triazole derivatives, phenazine derivatives, acridine derivatives or thiophene derivatives.

The binder resin used for the charge transport layer together with the charge transport material may be any one of a thermoplastic or thermosetting resin, e.g., polystyrene resin, styrene-acrylonitrile copolymer, styrene-butadiene copolymer, polyester resin, polyallylate resin, polycarbonate resin, acryl resin or epoxy resin, melamine resin and phenol resin. A thickness of the charge transport layer may advantageously be selected within a range of approximately 5 μm to approximately 30 μm in accordance with desired characteristics of the photoconductor.

A protective layer may be formed on the surface of the photoconductive element 5 as a surface layer for protecting the photoconductive layer and enhancing durability of the photoconductive layer. The protective layer including a binder resin with a filler may protect the photoconductive layer and mechanically improve the durability.

An amount of the filler added to the protective layer is preferably from approximately 10 to approximately 70 parts by weight per 100 parts by weight of the binder resin, and more preferably from approximately 20 to approximately 50 parts by weight per 100 parts by weight of the binder resin. If the amount of the filler is less than 10 parts by weight, abrasion of the protective layer can increase and the durability of the protective layer can decrease. If the amount is greater than 70 parts by weight, sensitivity of the photoconductive element 5 can significantly decrease and the residual potential of the photoconductive element 5 can increase.

Specific examples for use as the filler added to the protective layer include fine powders of metal oxides such as titanium oxides, silica, and alumina.

It is preferable that an average particle diameter of the filler added to the protective layer is from approximately 0.1 μm to approximately 0.8 μm. If the average particle diameter of the filler is too large, exposure light can be scattered by the protective layer. The scattered exposure light lowers resolving power, resulting in deterioration of an image quality. If the average particle diameter of the filler is too small, an abrasion resistance can decrease.

The protective layer is formed by dispersing a filler and a binder resin in an appropriate solvent, and applying the dispersion liquid obtained as above onto the photoconductive layer by a spray coating method. As binder resins and solvents for use in the protective layer, materials similar to those used in the charge transport layer may be used. Specific examples of the resins for use as the binder resin of the protective layer include a thermoplastic or thermosetting resin, e.g., polystyrene resin, styrene-acrylonitrile copolymer, styrene-butadiene copolymer, polyester resin, polyallylate resin, polycarbonate resin, acryl resin, epoxy resin, melamine resin and phenol resin. Specific examples of desired solvents are tetrahydrofuran, toluene and dicycloethane. A thickness of the protective layer is preferably from approximately 3 μm to approximately 10 μm to improve the durability of the protective layer and maintain electrostatic characteristics of the photoconductive layer. A charge transport material and an antioxidant may be added to the protective layer.

The protective layer of an organic photoconductive element is not limited to the protective layer formed by a dispersant including the filler. A protective layer of a cross-linking resin formed by incorporating a specific cross-linking compound into an organic silicon compound may also improve a mechanical strength of the photoconductive element 5.

As described above, the organic photoconductive element includes a protective layer to improve its mechanical strength. By this arrangement, the photoconductive layer of the photoconductive element resists deterioration when a pair of gap forming members contacts the photoconductive layer of the photoconductive element. The protective layer of the organic photoconductive element may include fine particles of metal oxide so that a mechanical strength of the photoconductive layer may increase.

Also, as described above, the protective layer of the organic photoconductive element having a cross-linking resin may increase a mechanical strength of the photoconductive layer.

The photoconductive element according to the present invention is not limited to the organic photoconductive element. That is, an inorganic photoconductive element such as an amorphous silicon photoconductive element may be used. Since such an inorganic photoconductive element generally has a better mechanical strength, the photoconductive element may not deteriorate even though the photoconductive element is held in contact with the pair of gap forming members. Accordingly, the inorganic photoconductive element formed of amorphous silicon may improve its mechanical strength. In addition, while some conventional inorganic photoconductive elements include hazardous substances such as arsenic and selenium, the amorphous silicon photoconductive element does not include these hazardous elements.

Figure 4:
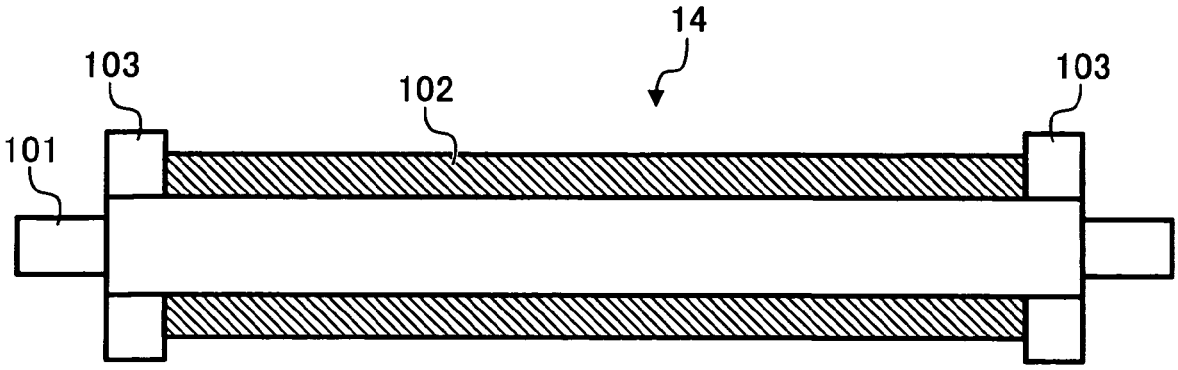
FIG. 4 is a cross sectional view of a charging roller arranged in the photoconductive unit of FIG. 3.

Referring to FIG. 4, a structure of the charging roller 14 for use in the present invention is described.

As shown in FIG. 4, the charging roller 14 has a circular cross section with a first radius and includes a metallic core 101 which is a conductive support member, a resin layer 102 serving as a charging member, and a pair of gap forming members 103.

The metallic core 101 is formed of stainless steel or other similar metal, and includes a rotational axis of the charging roller 14. If the diameter of the metallic core 101 is excessively small, deformation of the core 101 is not negligible when machined or pressed against the photoconductive element 5, making it difficult to accurately provide a desired gap. Conversely, if the diameter of the metallic core 101 is excessively large, the charging roller 14 becomes bulky or heavy. Thus, the diameter of the metallic core 101 is preferably between approximately 6 mm and approximately 10 mm.

The resin layer 102 of the charging roller 14 is preferably formed of a material having a volumetric resistance between approximately $10^4$ Ωcm and approximately $10^9$ Ωcm. If the volumetric resistance of the resin layer 102 is excessively low, a leakage of a charge bias may tend to occur when pin holes, for example, or other similar defects exist in the photoconductive element 5. If the volumetric resistance of the resin layer 102 is excessively high, the charge bias may not substantially be discharged and a charge potential may not be established. A desired volumetric resistance can be obtained if a conductive material is added to a base resin of the resin layer 102.

Specific examples of the material for use in the base resin include polyethylene, polypropylene, polymethyl methacrylate, polystyrene, acrylonitrile-butadiene-styrene (ABS) copolymer and polycarbonate. The above-described resins for the base resin are easily moldable.

Suitable materials for use as the conductive material may advantageously be made of an ionic conductive substance such as a high polymer containing a quaternary ammonium base. Suitable examples of the polyolefine having a quaternary ammonium base are polyethylene, polypropylene, polybutene, polyisoprene, ethylene-ethylacrylate copolymer, ethylene-methacrylate copolymer, ethylene-vinyl acetate copolymer, ethylene-propylene copolymer, and ethylene-hexene copolymer each having a quaternary ammonium base.

While the conductive material of the resin layer 102 in this embodiment is made of polyolefines having quaternary ammonium bases, high polymers other than the polyolefines having quaternary ammonium bases may be used.

The ionic conductive material described above can be uniformly distributed in the base resin if a biaxial kneader, kneader or other similar kneading means or apparatus is used. The base resin with the ionic conductive material can easily be molded into a roller shape by injection molding or extrusion molding. The content of the ionic conductive material may preferably be 30 parts by weight to 80 parts by weight for 100 parts by weight of the base resin.

The resin layer 102 of the charging roller 14 may preferably be from approximately 0.5 mm to approximately 3 mm thick. If the resin layer 102 is extremely thin, the resin layer 102 is difficult to mold and insufficient in strength. If the resin layer 102 is extremely thick, the charging roller 14 becomes bulky and increases an actual resistance of the resin layer 102, thereby lowers charging efficiency, for example.

After the resin layer 102 is formed, the pair of gap forming members 103, which include respective circular cross sections and are separately molded, is provided on both ends of the resin layer 102 by a method such as press fitting, adhesion using an adhesive and combination thereof, and is fixed to the metallic core 101. After the pair of gap forming members 103 is attached to the charging roller 14, an outer surface of the resin layer 102 is subjected to grinding or cutting so that a uniform gap is formed between the surface of the resin layer 102 and the surface of the photoconductive element 5. With the above-described structure, a ratio of each radius of the pair of gap forming members 103 to the radius of the resin layer 102 serving as a charging member is substantially constant through a whole rotational phase of the charging roller 14, resulting in a reduction of fluctuation of gap formed between the charging roller 14 and the photoconductive element 5.

On the contrary, if the outer surfaces of the resin layer 102 and the pair of gap forming members 103 are separately adjusted, the gap formed between the resin layer 102 and the pair of gap forming members 103 may not be uniformly formed, resulting in a gap difference. Such gap difference may make it difficult to maintain a gap less than 100 μm.

Figure 5:
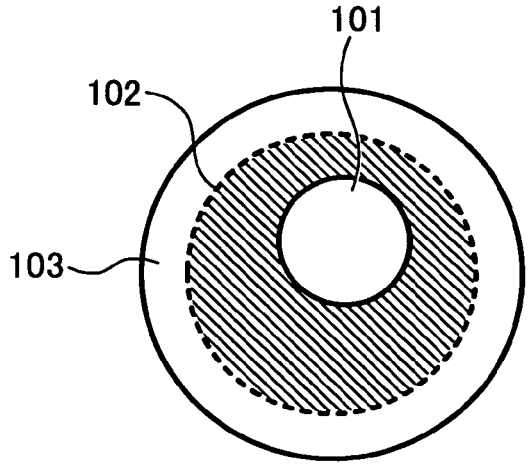
FIG. 5 is a cross sectional view of the charging roller having a uniform gap formed between outer surfaces of a resin layer of the charging roller and a gap forming member, viewed from one end of the charging roller.
Figure 6:
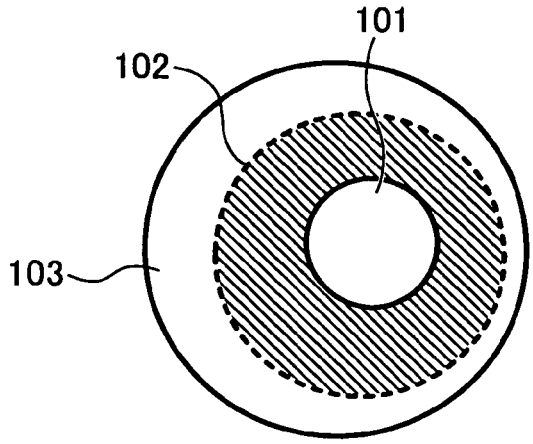
FIG. 6 is a cross sectional view of the charging roller having a non-uniform gap formed between outer surfaces of the resin layer and the gap forming member, viewed from a same direction as FIG. 5.

Referring to FIGS. 5 and 6, differences of gap formed between the resin layer 102 of the charging roller 14 and one of the pair of gap forming members 103 are shown.

As shown in FIG. 5, a uniform gap is formed between the resin layer 102 of the charging roller 14 and the one of the pair of gap forming members 103. That is, the ratio of each radius of the pair of gap forming members 103 and the radius of the resin layer 102 of the charging roller 14 is substantially constant through the whole rotational phase of the charging roller 14, with respect to the metallic core 101, resulting in small fluctuation of gap caused by rotations of the charging roller 14.

On the contrary, a gap formed between the resin layer 102 of the charging roller 14 and one of the pair of gap forming members 103 shown in FIG. 6 is not uniformly formed. That is, the resin layer 102 and the one of the pair of gap forming members 103 have different rotational phases, which may cause large fluctuation in gap when the charging roller 14 rotates.

Accordingly, if a uniform gap is formed between the charging roller 14 and the pair of gap forming members 103, the charging unit may reduce fluctuation of gap caused due to rotation of the charging roller, and may be easy cleaned over the surface of the charging roller.

The resin layer 102 of the charging roller 14 and the pair of gap forming members 103 may be integrally formed by a method such as a press fitting method and an adhesion method using an adhesive. In addition to the above-described methods, a coinjection molding method may be used. With this method, two different resins of the charging roller 14 and the pair of gap forming members 103 are molded on the metallic core 101.

The pair of gap forming members 103 includes an insulative resin material. Suitable materials for use in the pair of gap forming members 103 include polyolefin resins described above for use in the base resin of the resin layer 102 serving as a charging member, such as polyethylene, polypropylene, polymethyl methacrylate, polystyrene, acrylonitrile-butadiene-styrene (ABS) copolymer and polycarbonate.

Since the pair of gap forming members 103 is brought into contact with the surface of the photoconductive element 5, a material softer than the resin layer 102 of the charging member is preferably used.

In particular, polyacetal resins, ethylene-ethyl acrylate copolymers, polyvinylidene fluoride, tetrafluoroethylene-perfluoroalkylvinyl ether copolymers, and tetrafluoroethylene-hexafluoropropylene copolymers are preferably used because of having good slidability and hardly damaging the surface of the photoconductive element 5.

In addition, it is preferable to coat the surfaces of the resin layer 102 and the pair of gap forming members 103 with a material to which toner particles may not adhere and which has a thickness of several dozen micrometers.

As described above, the charging roller 14 is made of a resin material including an ionic conductive material and the pair of gap forming members 103 is made of an insulative resin material and has a hardness smaller than that of the charging roller 14. With the above-described configuration, the charging unit may be integrally configured and be easily processed with high precision, and the pair of gap forming members 103 of insulative material may be prevented from unnecessary discharge. Accordingly, the pair of gap forming members 103 may merely have its surface covered with toner, and the low hardness thereof may prevent deterioration of the photoconductive element 5 at which the pair of gap forming members 103 contacts.

As previously described, the pair of gap forming members 103 are held in contact with the photoconductive element 5 outside of an image forming area of the photoconductive element 5 so that a gap may be formed between the resin layer 102 of the charging roller 14 and the photoconductive element 5. A gear (not shown) mounted on an end of the metallic core 101 meshes with another gear (not shown) formed on a flange. In this configuration, when a drum drive motor (not shown) of the photoconductive element 5 causes the photoconductive element 5 to rotate, the charging roller 14 may rotate at substantially the same linear velocity as the photoconductive element 5.

Because the resin layer 102 and photoconductive element 5 do not contact each other, the photoconductive element 5 is protected from scratches even when the charging roller 14 and the photoconductive element 5 are formed of hard resin and an organic photoconductive element 5, respectively. The maximum gap is preferably 100 μm or less because an excessively large gap may cause abnormal discharge and may therefore obstruct uniform charging. It is therefore necessary to provide both of the photoconductive element 5 and the charging roller 14 with high accuracy, for example, a straightness of 20 μm or below.

Accordingly, a desired range of the gap between the photoconductive element 5 and the charging roller 14 may be from approximately 5 μm to approximately 100 μm to maintain the cleanliness of the charging unit and to prevent an occurrence of abnormal discharge due to a large gap.

Figure 7:
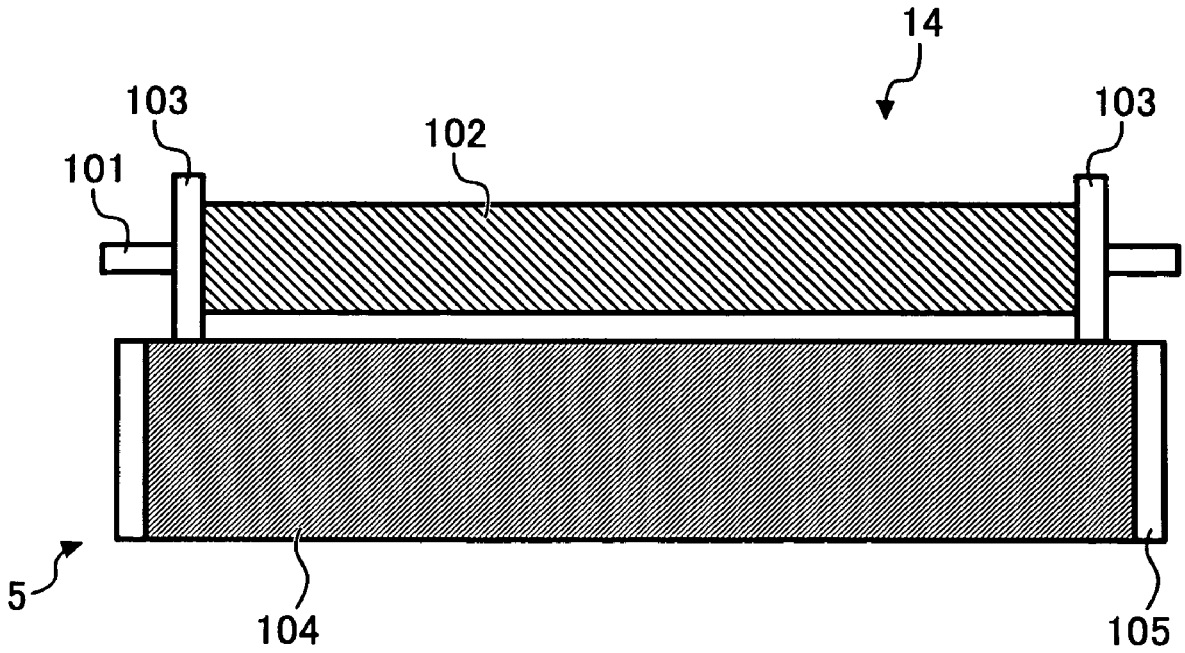
FIG. 7 is a front view showing positions of the charging roller contacting the image bearing member of the image forming apparatus according to the present invention.

Referring to FIG. 7, the charging roller 14 of the charging unit contacting on the photoconductive element 5 is described. In FIG. 7, the pair of gap forming members 103 is held in contact with the non-image forming area of the photoconductive layer 104 of the photoconductive element 5. That is, the pair of gap forming members 103 directly contacts a coated area of the photoconductive element 5.

As shown in FIG. 1, the pair of gap forming members 203 is conventionally held in contact with the tube 205 of the image bearing member 215. That is, the pair of gap forming members 203 does not touch the photoconductive layer 204. This is to prevent the leakage of the charge bias, and the photoconductive layer 204 formed on the tube 205 of the image bearing member 215 extends for a longer distance than the resin layer 202 of the charging member 214. Therefore, the tube 205 of the image bearing member 215 has an increased length in a longitudinal direction, resulting in a bulky size of an image forming apparatus.

In FIG. 7, the pair of gap forming members 103 includes a material which results in less damage to the photoconductive layer 104 than the pair of gap forming members 203 of FIG. 1. A protective layer 104 is applied to a surface of the photoconductive element 5 to increase the mechanical strength of the photoconductive element 5. Therefore, the pair of gap forming members 103 is permitted to contact the photoconductive layer 104.

Accordingly, as shown in FIG. 7, the resin layer 102 serving as a charge transport material may be arranged in a vicinity of each of the gap forming members 103. With the above-described structure, the photoconductive element 5 does not need to be extended in the longitudinal direction, thereby preventing the printer 1 from being bulky.

In the illustrative embodiment, it is preferable that the pair of gap forming members 103 includes a material having high resistance. Since the pair of gap forming members 103 may be held in contact with the photoconductive layer of the photoconductive element 5, a material having low or medium resistance may be applied to the pair of gap forming members 103. However, the material having high resistance may be more desired to prevent unnecessary electric discharge and electrostatic toner adhesion on the respective surfaces of the pair of gap forming members 103.

Even when the photoconductive element 5 and the charging roller 14 have the straightness not greater than 20 μm, the gap varies within a certain range. To uniformly charge the photoconductive element 5 even under such conditions, it is preferable that the resin layer 102 apply a DC bias overlapped with an AC bias which has a peak-to-peak voltage not less than twice the voltage at which discharging begins to occur between the resin layer 102 and the surface of the photoconductive element 5. A frequency of the AC bias is preferably from seven to twelve times the linear velocity of the photoconductive element 5. When the frequency of the AC bias is too low, stripe-form uneven charging is caused, resulting in formation of undesired stripe images. In contrast, when the frequency of the AC bias is too high, excessive charging is performed, thereby increasing an amount of abrasion of the photoconductive element 5. In addition, a filming of toner used and the external additive in the toner tends to be formed on the surface of the photoconductive element 5.

As described above, the AC bias which has a peak-to-peak voltage not less than twice the voltage at which discharging begins to occur between the charging roller 14 and the photoconductive element 5 may be applied to the charging roller, and the frequency (Hz) of the AC bias may be from seven times to twelve times the linear velocity (mm/s) of the photoconductive element. By this arrangement, even when the gap between the photoconductive element 5 and the charging roller 14 is unevenly formed according to rotations of the charging roller 14, a constant charge potential may be provided.

As a cleaning member for the charging roller 14, a charge cleaning brush may be provided at an upper portion of the charging roller 14. The charge cleaning brush may include a metallic core having a diameter of 6 mm, a surface of which is electrostatically implanted with insulative fibers having a length of 1 mm. The charge cleaning brush is rotatably held in contact by its own weight with the charging roller 14 to rotate in an opposite direction of rotation of the charging roller 14 so that the charge cleaning brush may clean the surface of the charging roller 14. Since the cleaning brush contacts the charging roller 14 by its own weight without a pressing member such as a spring, the deformation of the metallic core 101 may be of interest even when the diameter of the metallic core 101 is small.

If the charge cleaning brush is longer than the charging roller 14 including the pair of gap forming members 103, the charge cleaning brush may clean both a surface of a charging area of the charging roller 14 and respective surfaces of the pair of gap forming members 103. Even though these surfaces of the charging roller 14 have different outer diameters, the difference of the outer diameters is several dozen micrometers, 100 μm at most. Since a distance between the outer diameters of the charging roller 14 is smaller than the length of the charge cleaning brush, cleanliness of the charging area of the charging roller 14 may be maintained.

Numerous additional modifications and variations are possible in light of the above teachings. It is therefore to be understood that within the scope of the appended claims, the disclosure of this patent specification may be practiced otherwise than as specifically described herein.

The invention claimed is:

1. An image forming apparatus, comprising:

an image bearing member comprising a photoconductive surface including an image forming area configured to bear an electrostatic latent image and a non-image forming area;

a charging roller having a circular cross section with a first radius, the charging roller comprising a metallic core having a same rotational axis as the charging roller and a charging surface configured to charge the photoconductive surface of the image bearing member; and a pair of gap forming members disposed on longitudinal ends of the charging surface of the charging roller in direct contact with the metallic core and configured to contact longitudinal ends of the image bearing member to form a gap at least between the image forming area of the photoconductive surface of the image bearing member and the charging surface of the charging roller, each of the gap forming members having a circular cross section with a second radius such that a ratio of the second radius to the first radius is substantially constant through an entire rotational phase of the charging roller.

2. The image forming apparatus according to claim 1, wherein the charging roller comprises a resin material including an ionic conductive material, and the pair of gap forming members comprises an insulative resin material and has a hardness lower than a hardness of the charging roller.

3. The image forming apparatus according to claim 1, wherein the pair of gap forming members is held in contact with the photoconductive surface in the non-image forming area of the image bearing member.

4. The image forming apparatus according to claim 1, wherein the image bearing member comprises an organic photoconductive element having a protective layer on a surface thereof.

5. The image forming apparatus according to claim 4, wherein the protective layer of the organic photoconductive element comprises metal oxide.

6. The image forming apparatus according to claim 4, wherein the protective layer of the organic photoconductive element comprises a cross-linking resin.

7. The image forming apparatus according to claim 1, wherein the image bearing member comprises an inorganic photoconductive element including amorphous silicon.

8. The image forming apparatus according to claim 3, wherein the gap between the image bearing member and the charging roller is from approximately 5 μm to approximately 10 μm.

9. The image forming apparatus according to claim 8, wherein the charging roller is configured to receive an AC voltage superposed on a DC voltage, having a peak-to-peak voltage that is at least two times a discharge start voltage between the charging roller and the image bearing member.

10. The image forming apparatus according to claim 9, wherein a frequency of the AC voltage is from seven to twelve times a linear velocity of the image bearing member.

11. The image forming apparatus according to claim 1, wherein at least the image bearing member and the charging roller are integrally disposed in a cartridge configured to be removed from the image forming apparatus.

12. An image forming apparatus, comprising:

means for bearing an image, the means for bearing comprising a photoconductive surface including an image forming area and a non-image forming area;

means for charging the means for bearing, the means for charging having a circular cross section with a first radius, the means for charging comprising a metallic core having a same rotational axis as the means for charging and a charging surface configured to charge the photoconductive surface of the means for bearing; and means for forming a gap disposed on longitudinal ends of the charging surface and in direct contact with the metallic core of the means for charging, configured to contact longitudinal ends of the means for bearing, the means for forming a gap configured to form a gap at least between the image forming area of the photoconductive surface of the means for bearing and the charging surface of the means for charging, the means for forming having a circular cross section with a second radius such that a ratio of the second radius to the first radius is substantially constant through an entire rotational phase of the means for charging.

13. The image forming apparatus according to claim 12, wherein the means for charging comprises a resin material including an ionic conductive material, and the means for forming comprises an insulative resin material and has a hardness lower than a hardness of the means for charging.

14. The image forming apparatus according to claim 12, wherein the means for forming is held in contact with the photoconductive surface in the non-image forming area of the means for bearing.

15. The image forming apparatus according to claim 12, wherein the means for bearing comprises an organic photoconductive element having a protective layer on a surface thereof.

16. The image forming apparatus according to claim 15, wherein the protective layer of the organic photoconductive element comprises metal oxide.

17. The image forming apparatus according to claim 15, wherein the protective layer of the organic photoconductive element comprises a cross-linking resin.

18. The image forming apparatus according to claim 12, wherein the means for bearing comprises an inorganic photoconductive element including amorphous silicon.

19. The image forming apparatus according to claim 14, wherein the gap formed between the means for bearing and the means for charging is from approximately 5 μm to approximately 10 μm.

20. The image forming apparatus according to claim 19, wherein the means for charging is configured to receive an AC voltage superposed on a DC voltage, having a peak-to-peak voltage that is at least two times a discharge start voltage between the means for charging and the means for bearing.

21. The image forming apparatus according to claim 20, wherein a frequency of the AC voltage is from seven to twelve times a linear velocity of the means for bearing.

22. The image forming apparatus according to claim 12, wherein at least the means for bearing and the means for charging are integrally disposed in a cartridge configured to be removed from the image forming apparatus.

23. A method of forming an image, comprising:

providing an image bearing member comprising a photoconductive surface including an image forming area configured to bear an electrostatic latent image and a non-image forming area;

providing a charging roller having a circular cross section with a first radius, the charging roller comprising a metallic core having a same rotational axis as the charging roller and a charging surface;

providing a pair of gap forming members, each of the gap forming members having a circular cross section with a second radius;

mounting the pair of gap forming members on the charging roller in direct contact with the metallic core such that a ratio of the second radius to the first radius is substantially constant through a whole rotational phase of the charging roller;

arranging the charging roller integrally mounted by the pair of gap forming members such that the charging roller is disposed parallel to and close to the image bearing member and the pair of gap forming members is held in contact with longitudinal ends of the image bearing member to form a gap at least between the image forming area of the photoconductive surface of the image bearing member and the charging surface of the charging roller;

uniformly charging the image forming area on the surface of the image bearing member; and forming an electrostatic latent image in the image forming area on the surface of the image bearing member.

24. The method according to claim 23, wherein charging comprises receiving an AC voltage superposed on a DC voltage which has a peak-to-peak voltage that is at least two times a discharge start voltage between the charging roller and the image bearing member.

25. The method according to claim 24, wherein a frequency of the AC voltage is from seven to twelve times a linear velocity of the image bearing member.

26. A charging unit, comprising:

a charging roller having a circular cross section with a first radius, the charging roller comprising a metallic core having a same rotational axis as the charging roller and a charging surface configured to charge a photoconductive surface of an image bearing member; and a pair of gap forming members configured to contact longitudinal ends of the image bearing member in direct contact with the metallic core to form a gap at least between an image forming area of a photoconductive surface of the image bearing member and the charging surface of the charging roller, each of the gap forming members having a circular cross section with a second radius such that a ratio of the second radius to the first radius is substantially constant through an entire rotational phase of the charging roller.

27. The charging unit according to claim 26, wherein the charging roller comprises a resin material including an ionic conductive material, and the pair of gap forming members comprises an insulative resin material and has a hardness lower than a hardness of the charging roller.

28. The charging unit according to claim 26, wherein the pair of gap forming members is configured to be held in contact with the photoconductive surface in a non-image forming area of the image bearing member.

29. A charging unit, comprising:

means for charging a means for bearing an image, the means for charging having a circular cross section with a first radius, the means for charging comprising a metallic core having a same rotational axis as the means for charging and a charging surface configured to charge a photoconductive surface of the means for bearing; and means for forming a gap disposed on longitudinal ends of the charging surface and in direct contact with the metallic core of the means for charging, configured to contact longitudinal ends of the means for bearing, the means for forming a gap configured to form a gap at least between an image forming area of a photoconductive surface of the means for bearing and the charging surface of the means for charging, the means for forming having a circular cross section with a second radius such that a ratio of the second radius to the first radius is substantially constant through an entire rotational phase of the means for charging.

30. The charging unit according to claim 29, wherein the means for charging comprises a resin material including an ionic conductive material, and the means for forming comprises an insulative resin material and has a hardness lower than a hardness of the means for charging.

31. The charging unit according to claim 29, wherein the means for forming is configured to be held in contact with the photoconductive surface in a non-image forming area of the image bearing member.

32. A method of charging, comprising:

providing a charging roller having a circular cross section with a first radius, the charging roller comprising a metallic core having a same rotational axis as the charging roller and a charging surface;

providing a pair of gap forming members, each of the gap forming members having a circular cross section with a second radius;

mounting the pair of gap forming members on the charging roller in direct contact with the metallic core such that a ratio of the second radius to the first radius is substantially constant through en entire rotational phase of the charging roller; and uniformly charging an image forming area on a photoconductive surface of an image bearing member.

33. A process cartridge, comprising:

a housing;

an image bearing member comprising a photoconductive surface including an image forming area configured to bear an electrostatic latent image and a non-image forming area; and a charging unit comprising:

a charging roller having a circular cross section with a first radius, the charging roller comprising a metallic core having a same rotational axis as the charging roller and a charging surface configured to charge the photoconductive surface of the image bearing member; and a pair of gap forming members disposed on longitudinal ends of the charging surface of the charging roller in direct contact with the metallic core and configured to contact longitudinal ends of the image bearing member to form a gap at least between the image forming area of the photoconductive surface of the image bearing member and the charging surface of the charging roller, each of the gap forming members having a circular cross section with a second radius such that a ratio of the second radius to the first radius is substantially constant through an entire rotational phase of the charging roller.

34. The process cartridge device according to claim 33, wherein the charging roller comprises a resin material including an ionic conductive material, and the pair of gap forming members comprises an insulative resin material and has a hardness lower than a hardness of the charging roller.

35. The process cartridge according to claim 33, wherein the pair of gap forming members is held in contact with the photoconductive surface in the non-image forming area of the image bearing member.

36. A process cartridge, comprising:

a housing;

means for bearing an image, the means for bearing comprising a photoconductive surface including an image forming area and a non-image forming area; and a charging unit comprising:

means for charging the means for bearing, the means for charging having a circular cross section with a first radius, the means for charging comprising a metallic core having a same rotational axis as the means for charging and a charging surface configured to charge the photoconductive surface of the means for bearing; and means for forming a gap disposed on longitudinal ends of the charging surface and in direct contact with the metallic core of the means for charging, configured to contact longitudinal ends of the means for bearing, the means for forming a gap configured to form a gap at least between the image forming area of the photoconductive surface of the means for bearing and the charging surface of the means for charging, the means for forming having a circular cross section with a second radius such that a ratio of the second radius to the first radius is substantially constant through an entire rotational phase of the means for charging.

37. The process cartridge according to claim 36, wherein the means for charging comprises a resin material including an ionic conductive material, and the means for forming comprises an insulative resin material and has a hardness lower than a hardness of the means for charging.

38. The process cartridge according to claim 36, wherein the means for forming is held in contact with the photoconductive surface in the non-image forming area of the image bearing member.

39. A method of producing a process cartridge, comprising the steps of:

providing a housing;

providing in the housing an image bearing member comprising a photoconductive surface including an image forming area configured to bear an electrostatic latent image and a non-image forming area;

providing a charging roller having a circular cross section with a first radius, the charging roller comprising a metallic core having a same rotational axis as the charging roller and a charging surface;

providing a pair of gap forming members, each of the gap forming members having a circular cross section with a second radius;

mounting the pair of gap forming members on the charging roller in direct contact with the metallic core such that a ratio of the second radius to the first radius is substantially constant through a whole rotational phase of the charging roller;

arranging the charging roller integrally mounted by the pair of gap forming members such that the charging roller is disposed parallel to and close to the image bearing member and the pair of gap forming members is held in contact with longitudinal ends of the image bearing member to form a gap at least between the image forming area of the photoconductive surface of the image bearing member and the charging surface of the charging roller;

uniformly charging the image forming area on the surface of the image bearing member; and forming an electrostatic latent image in the image forming area on the surface of the image bearing member.

* * * * *